US008607936B2

(12) United States Patent
Szentistvany et al.

(10) Patent No.: US 8,607,936 B2
(45) Date of Patent: Dec. 17, 2013

(54) IN OR RELATING TO STAIRLIFTS

(75) Inventors: Andreas Csaba Szentistvany, Hampshire (GB); Martin John Colenutt, Hampshire (GB)

(73) Assignee: Stannah Stairlifts Limited, Hampshire (GB)

( * ) Notice: Subject to any disclaimer, the term of this patent is extended or adjusted under 35 U.S.C. 154(b) by 1064 days.

(21) Appl. No.: 12/311,942

(22) PCT Filed: Oct. 17, 2007

(86) PCT No.: PCT/GB2007/003959

§ 371 (c)(1), (2), (4) Date: Nov. 16, 2009

(87) PCT Pub. No.: WO2008/047116

PCT Pub. Date: Apr. 24, 2008

(65) Prior Publication Data

US 2010/0101894 A1 Apr. 29, 2010

(30) Foreign Application Priority Data

Oct. 20, 2006 (GB) ..... 0620861.5

(51) Int. Cl.

*B66B 9/08* (2006.01)
*A61G 5/06* (2006.01)
*B61B 12/12* (2006.01)

(52) U.S. Cl.

USPC ..... 187/201; 104/230; 104/231; 104/232; 104/233

(58) Field of Classification Search

CPC ..... B66B 9/08; B61B 12/12; B61B 3/00; A61G 3/04; A61G 5/06

USPC ..... 187/201; 414/921; 104/229–234, 245, 104/288

See application file for complete search history.

(56) References Cited

U.S. PATENT DOCUMENTS

| | | | | | |
|---|---|---|---|---|---|
| 6,155,382 | A * | 12/2000 | Duijnstee | ..... | 187/200 |
| 2004/0104078 | A1* | 6/2004 | Szentistvany et al. | ..... | 187/201 |
| 2008/0271953 | A1* | 11/2008 | Vroegindeweij | ..... | 187/245 |
| 2011/0024237 | A1* | 2/2011 | Vroegindeweij | ..... | 187/201 |

FOREIGN PATENT DOCUMENTS

| | | | | | |
|---|---|---|---|---|---|
| EP | 1 449 801 | | 8/2004 | | |
| EP | 2216284 | A1 * | 8/2010 | ..... | B66B 9/08 |
| JP | 10077176 | A * | 3/1998 | ..... | B66B 9/08 |
| JP | 2001253666 | A * | 9/2001 | ..... | B66B 9/08 |
| WO | WO 02/064481 | | 8/2002 | | |
| WO | WO 2005/085116 | | 9/2005 | | |

OTHER PUBLICATIONS

International Search Report for PCT/GB2007/003959 mailed Mar. 14, 2008.

* cited by examiner

*Primary Examiner* — William A Rivera
*Assistant Examiner* — Stefan Kruer
(74) *Attorney, Agent, or Firm* — Nixon & Vanderhye, PC

(57) ABSTRACT

A roller arrangement (20) for a stairlift carriage is described, the arrangement including a central roller set (22), and outer roller sets (24) and (26). Rollers (42), (43, 44) and (45) in the outer roller sets are mounted in yokes (48) which are mounted for independent pivotal movement, relative to one another, in two orthogonal axes. The axes of each set preferably lie in common planes.

19 Claims, 8 Drawing Sheets

IN OR RELATING TO STAIRLIFTS

This application is the U.S. national phase of International Application No. PCT/GB2007/003959 filed 17 Oct. 2007 which designated the U.S. and claims priority to British Patent Application No. 0620861.5 filed 20 Oct. 2006, the entire contents of each of which are hereby incorporated by reference.

FIELD OF THE INVENTION

This invention relates to stairlifts

BACKGROUND TO THE INVENTION

Stairlifts typically comprise a carriage, mounted by way of support rollers, on a stairlift rail, for movement along the rail. The carriage includes a drive motor and gearbox and includes some form of drive transfer mechanism, such as a drive pinion or friction wheel, which cooperates with the rail to effect movement of the carriage along the rail.

In the case of curved stairlifts, the arrangement of support rollers (sometimes referred to as a skate) must be of a form which enables the carriage to accommodate and traverse bends in both a vertical plane (transition bends) and in a horizontal plane (inside/outside bends). Further, it is preferred that the skate assembly is also configured to allow the carriage to accommodate and traverse bends that combine elements of vertical and horizontal curve simultaneously. These will be referred to hereinafter as helicals. Different rails have bends of different geometry, the geometry being dictated by the form of the staircase to which the stairlift is fitted. The skate must be configured in such a manner as to accommodate all such bends, whatever their geometry and, ideally, the plane of each skate roller should be substantially parallel to the lengthwise axis of that part of the rail with which it is in contact, so as to avoid crabbing. Crabbing not only detracts from ride quality but also leads to excessive wear of the rollers and/or roller bearings. This wear, in turn, leads to increased clearance between the carriage and the rail which further detracts from ride quality.

In order to maintain the drive mechanism in the correct relationship to the rail at all times, a form of skate has been developed having a central roller set, and an outer roller set on each side of the central set. The central roller set locates the carriage on the rail and, whilst it can move along the rail, its position is otherwise fixed in relationship to the rail. The drive pinion is included in the central roller set and is thus always correctly located in relationship to the rack, extending along the rail, whatever the direction assumed by the rail.

The outer roller sets act as guide rollers, and provide stability to the carriage. In order to provide both functions simultaneously, the outer roller sets must be displaceable, simultaneously, relative to the central roller set and also provide pivotal, or steering, action relative to the central roller set.

Examples of stairlift skate of the above form can be seen in European Patent 0 853 591 and in our own published International Patent Application WO 2005/085116.

In the case of European Patent 0 853 591, the outer roller sets are carried on the outer ends of two frames which are connected by a ball and socket joint at their inner ends. Each frame is mounted on a swivel joint at a fixed point intermediate its ends. As a consequence, the movement of one outer roller set is always mirrored by the other outer roller set, and the necessary simultaneous displacement of the outer roller sets is effected by the same mechanism that provides the pivotal action to allow steering. The relatively long arcs through which the arms pivot, occupy significant space and limit the sharpness of angle through which the carriage can move. Having said that, this arrangement performs relatively satisfactorily in transition bends, where the planes in which the rollers rotate are always substantially parallel to the rail axis, but is far from ideal in inside/outside bends. Because movement in inside/outside bends is strictly mirrored, as the leading roller set enters or exits an inside/outside bend, the trailing roller set will be adjusted into an angle such that the planes in which the individual rollers rotate, will not be parallel to the rail axis. As a consequence, the rollers will crab. The same mirrored linkages also cause the outer roller sets to crab in transition bends. Further, because the axes about which the frames rotate, are spaced from the central coupling, and because a degree of backlash is inherent in mechanical linkages of this type, there is a degree of instability in the assembly, particularly when a heavy twisting load is applied to the carriage. This instability is exacerbated at steeper rail angles.

WO 2005/085116 provides an alternative. Unlike EP '591 in which movement through both transition bends and inside/outside bends is controlled by the same linkages, in WO '116, movement in transitions is accommodated by a combined rotation/displacement mechanism, whilst movement through inside/outside bends is accommodated by a linkage not dissimilar to that shown in EP '591. The outer roller sets are not mirrored together in transition bends, do not crab in transition bends, and the combined rotation displacement action in transition bends results in a mechanism which is both compact and can accommodate bends of quite an acute angle. However, in inside/outside bends, the skate described in WO '116 is susceptible to the same criticism as that made above in relation to EP '591.

It is an object of this invention to provide a stairlift, or a skate for a stairlift in which the various aspects of the invention go at least some way in addressing the problems set out above; or which will at least provide a novel and useful choice.

SUMMARY OF THE INVENTION

Accordingly, in one aspect, the invention provides a stairlift carriage for mounting on a stairlift rail having a rail axis, said carriage including:

a central roller set to locate and retain said carriage on said rail; and outer roller sets on either side of said central roller set, said outer roller sets being operable to guide said carriage through transition and/or inside/outside bends in said rail, said carriage being characterised in that each outer roller set is capable of pivotal movement about two substantially orthogonal axes which is independent from movement of the other outer roller set.

Preferably said two orthogonal axes lie on a common plane.

Preferably said common plane is substantially perpendicular to said rail axis.

Preferably said carriage further includes a connection to cause said simultaneous displacement of said outer roller sets with respect to said central roller set in both transition bends and inside/outside bends.

Preferably said connection includes a cross-member on which each outer roller set is mounted, said cross-member being slidable in a substantially vertical direction.

Preferably said cross-member is also displaceable about an axis spaced from, but substantially parallel to, a line extending between said outer roller sets.

Preferably each outer roller set includes a top and bottom roller, positioned to engage, respectively surfaces of said rail at or adjacent the upper and lower edges thereof; and a plurality of steering rollers positioned to engage opposed side surfaces of said rail.

Preferably said top and bottom rollers are mounted in a substantially common plane, said bottom roller being displaceable in said plane.

In a second aspect, the invention provides a stairlift carriage for mounting on a stairlift rail, said carriage including:
a central roller set to locate and retain said carriage on said rail; and
outer roller sets on either side of said central roller set, said outer roller sets being operable to guide said carriage through transition and/or inside/outside bends in said rail,
said carriage being characterised in that each outer roller set is capable of pivotal movement about two substantially orthogonal axes, the axes of each roller set lying in a common plane, the plane of one set being substantially parallel to the plane of the other set when said carriage is on a straight section of rail.

Preferably said outer roller sets are mounted on a common connection.

In a third aspect, the invention provides a stairlift carriage for mounting on a stairlift rail, said carriage including:
a central roller set to locate and retain said carriage on said rail;
outer roller sets on either side of said central roller set, said outer roller sets being operable to guide said carriage through transition and/or inside/outside bends in said rail,
a connection linking said outer roller sets and operable to ensure simultaneous displacement of said outer roller sets with respective to said central roller set, said carriage being characterised in that each outer roller set is mounted to said connection for independent pivotal movement about two substantially orthogonal axes.

Preferably said connection comprises a substantially rigid cross-member.

In a fourth aspect, the invention provides a stairlift carriage for mounting on a stairlift rail, said carriage including:
a central roller set to locate and retain said carriage on said rail;
outer roller sets on either side of said central roller set, said outer roller sets being operable to guide said carriage through transition and/or inside/outside bends in said rail,
a connection linking said outer roller sets and operable to ensure simultaneous displacement of said outer roller sets with respective to said central roller set,
said carriage being characterised in that said connection comprises a substantially rigid cross-member, each outer roller set being independently mounted to said cross-member for pivotal movement about two substantially orthogonal axes.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The various aspects of the invention will now be described with reference to to the accompanying drawings in which.

DETAILED DESCRIPTION OF WORKING EMBODIMENT

Figure 1:
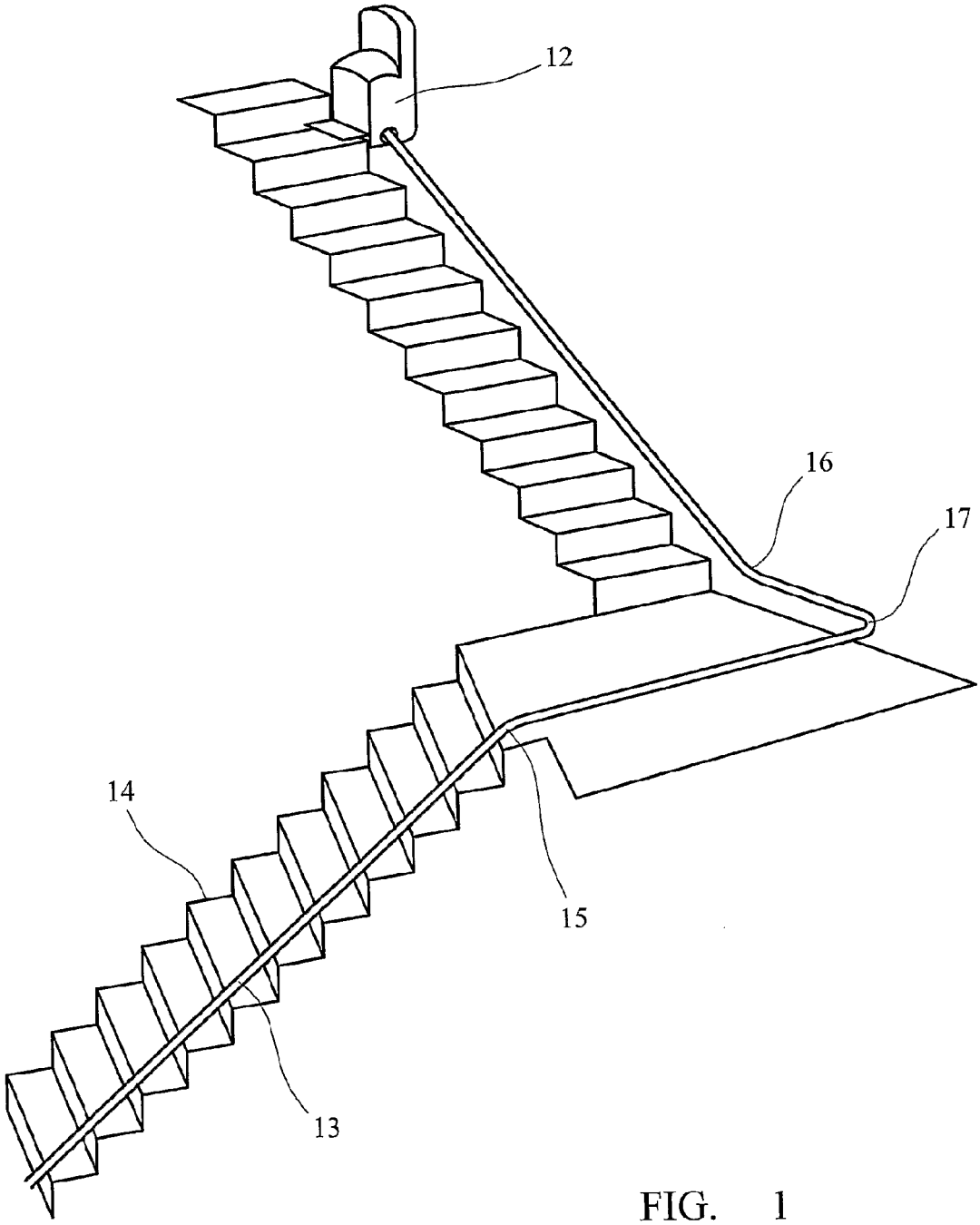
FIG. 1: shows an isometric view of a typical curved stairlift installation.

Referring firstly to FIG. 1, the invention provides a roller arrangement, or skate, for mounting a stairlift carriage 12 on a stairlift rail 13, the rail extending along stairway 14. Whilst the roller arrangement described herein could be used to mount a carriage for movement along a straight rail, the same has been devised to allow the carriage to travel along a rail which changes direction in vertical and/or horizontal planes. To this end, in the form shown, the rail 13 includes a negative transition bend 15 (in which the angle of the rail with respect to the horizontal decreases in an uphill direction), a positive transition bend 16 (in which the angle of the rail with respect to the horizontal increases in an uphill direction), and an outside bend 17, in which the rail is curved in a substantially horizontal plane around the outside of a corner in the stairway 14. As will be apparent from the description which follows, the particular roller arrangement disclosed herein has also been devised to allow passage of the carriage over helical bends in which the rail turns and rises or falls at the same time. Such a bend is not specifically illustrated in FIG. 1.

Referring now to FIGS. 2 to 14, a skate 20 is shown which is included within the carriage 12. In the form shown, this comprises a central roller set 22, a first outer roller set 24 and a second outer roller set 26. As can best be seen in FIG. 2, the outer roller sets 24 and 26 are located on opposite sides of the central roller set 22 and, when the carriage is traversing a straight section of rail, the roller sets 22, 24 and 26 are arranged in line.

At this point it should be emphasised that the particular roller configuration described below has been established to operate in conjunction with a rail cross section as described in our published International Patent Application WO 02/064481, or as described in our pending International Patent Application WO 2004/043845, the latter cross section being shown in dotted outline in FIGS. 2, 7, 10 and 13. The important feature of both of these forms of rail is that they comprise, when viewed in cross-section, at least elements of one round section located vertically above another. It will be appreciated, however, that the invention could be adapted for use with rails of alternative cross-sections.

A feature of the rail described both in WO 02/064481 and WO 2004/043845 is that, when a helical is formed therein, the upper rail tubular section comprises the 'control' section and the lower rail tubular section is offset from the vertical axis of the top section to create the helical. The circular cross section of the upper part of the rail allows the rollers of the outer roller sets to assume positions which are rotated about the axis of the upper part of the rail from those which are assumed when the carriage is traversing a straight section of rail.

Whatever the cross-section, the central roller set 22 provides the anchor for the carriage on the rail in the sense that the central roller set cannot move vertically with respect to the rail, or rotate about the axis of the rail. To this end, the central roller set includes a top roller 30 (FIGS. 12 & 14), a bottom roller 31, an inner lower lateral roller 32 and an upper outer lateral roller 33. It will be appreciated that the vertically oriented rollers 30 and 31 locate the carriage vertically with respect to the rail, whilst the lateral rollers 32 and 33 prevent rotation of the carriage about the axis of the rail 13.

The rollers 30, 32 and 33 are mounted on a central chassis 35, the chassis 35 being the main fixing point to the remainder of the carriage assembly. The bottom roller 31 is mounted on and co-axial with drive shaft 36, the drive shaft 36 being rotated by a motor/gearbox unit 37. Drive pinion 38 is keyed to the outer end of the drive shaft 36 and engages rack (not shown) extending along the rail 13 adjacent the lower edge of the rail. Thus, rotation of the pinion 38 causes the carriage to move longitudinally of the rail 13 in the known manner.

The bottom roller 31 is freely rotatable on the drive shaft 36 and can also move along the axis of the drive shaft 36.

Figure 2:
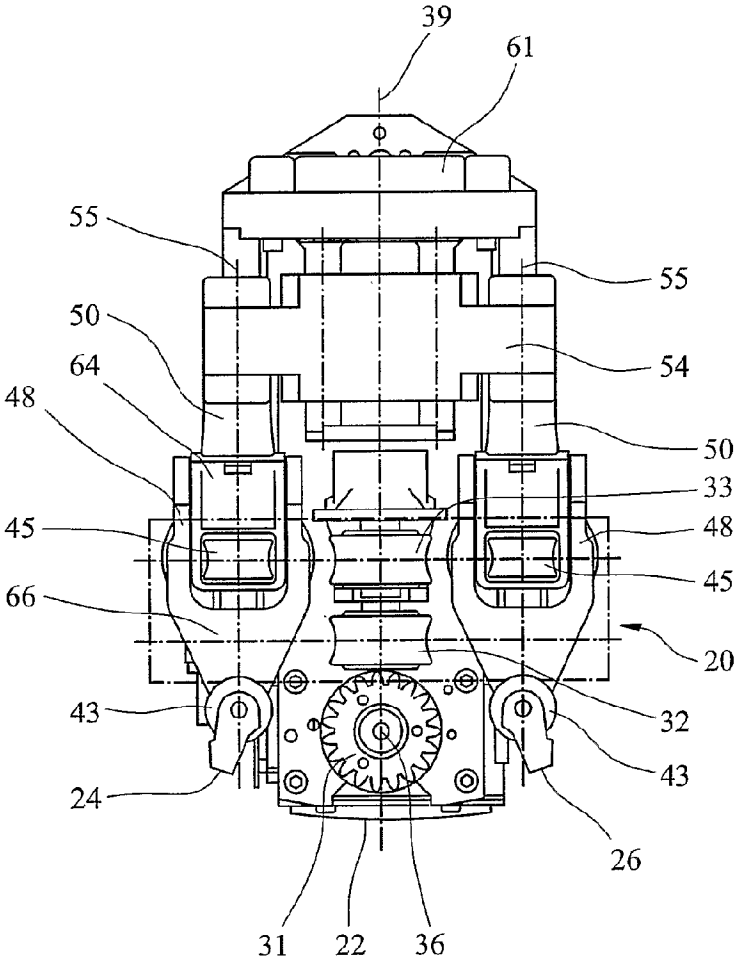
FIG. 2: shows a rear view of a carriage roller arrangement according to the invention.

As can best be seen in FIG. 2, the central roller set has a geometric centre line 39 which, for present purposes, will be referred to as a reference axis 39.

Figure 3:
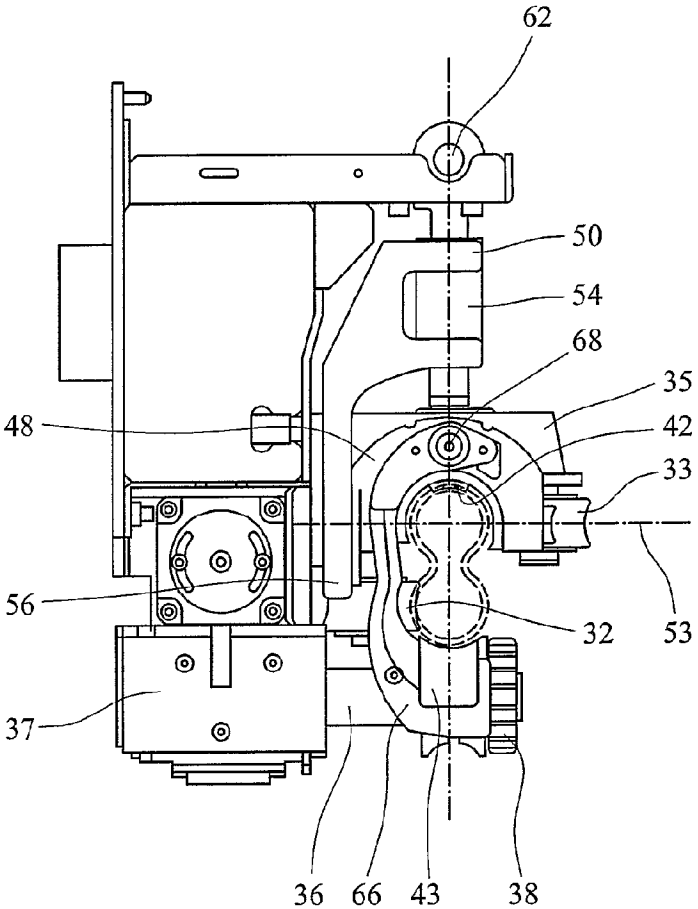
FIG. 3: shows a side view of the carriage roller arrangement shown in FIG. 2.

The two outer roller sets 24 and 26 are substantially identical. Each includes a top roller 42 (FIGS. 12 & 13), a bottom roller 43 and two lateral steering rollers 44 and 45. The rollers 42, 43, 44 and 45 of each set are mounted in a common cradle or yoke 48. Each yoke 48 is, in turn, mounted on a sub-frame 50 via a pivot bearing 52 (FIGS. 13 & 14) so that the yokes with attached rollers can pivot in substantially vertical planes about axes 53. As can be seen in FIG. 3, when the carriage is mounted on the rail, axes 53 pass through, or very nearly through, the centreline of the upper half of the rail.

The outer roller sets are interconnected so that they are displaced simultaneously, with respect to the central roller set 22, in both transition bends and in inside/outside bends. To this end, in the form shown, the sub-frames 50 are mounted on a common cross-member 54 by vertical pivot pins 55. It can also be seen that the sub-frames 50 extend forward of the cross member and then down, the downwardly extending arm 56 carrying the pivot bearing 52. This arrangement ensures that, when the skate is in the configuration shown FIG. 3, the axes of the vertical pivots 55 lie substantially on a vertical plane through the centreline of the rail. Further, when viewed from the rear, as shown in FIG. 2, the axes of pivots 55, and the horizontal pivot axes 53, lie on substantially common vertical planes. The commonality of pivot locations plays an important role in addressing the stability problems of prior art roller arrangements referred to above.

When viewed as in FIG. 2, the pivot pins 55 may be mounted with a small amount of castor (for example 5°) to assist the outer roller sets to self-centre when exiting inside/outside bends.

In the particular form shown, the cross-member 54 is slidably mounted on spaced vertical pillars 60, and can thus move up and down the pillars 60. The pillars 60, in turn, extend from link 61 located in a top part of the carriage chassis and mounted so as to enable pivotal movement about axis 62. Thus the assembly comprising the cross member 54, sub-frames 50, yokes 48 and rollers 42, 43, 44 and 45 can pivot about the axis 62. This enables the skate to negotiate inside/outside bends and will be described in greater detail below.

Figure 12:
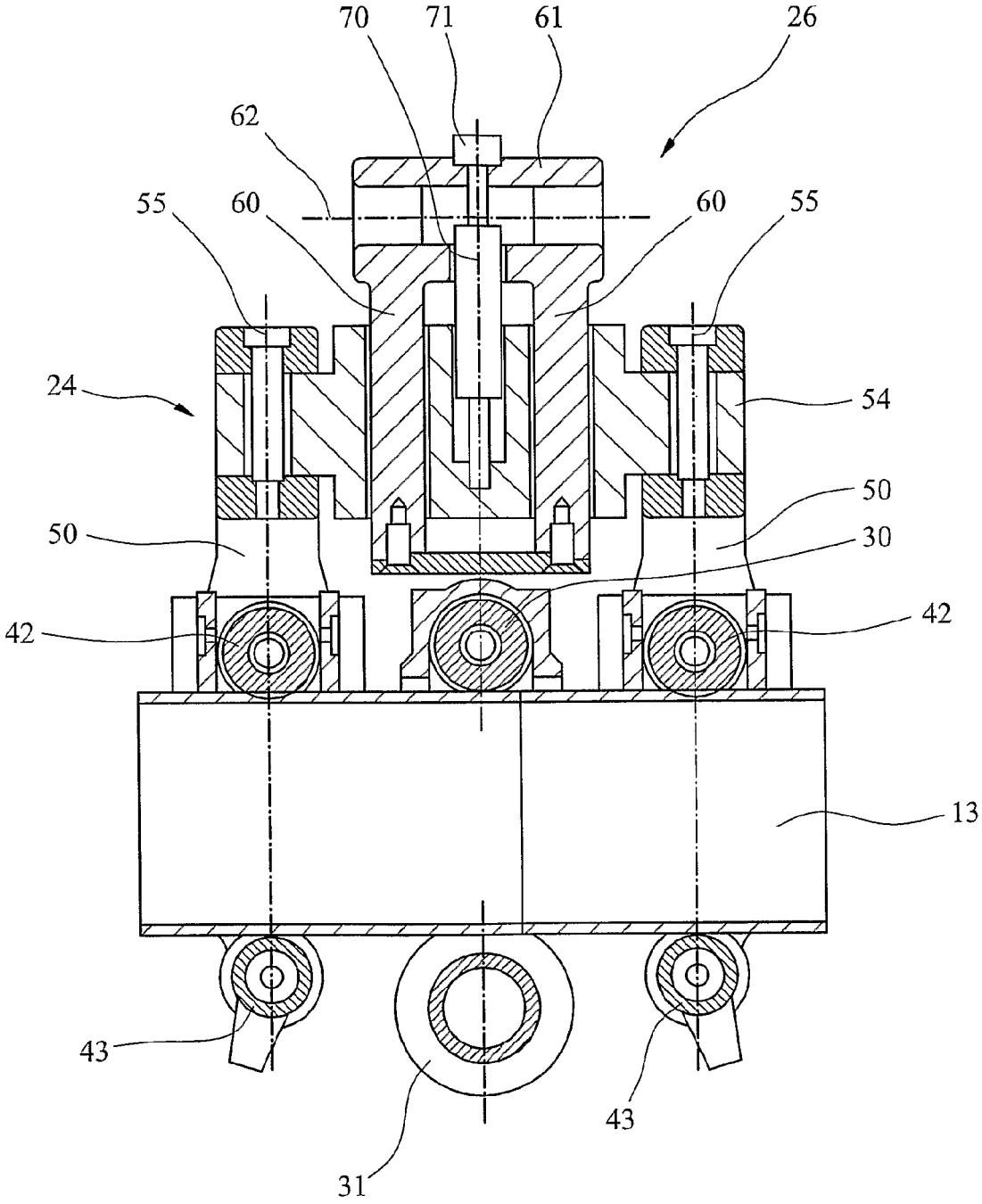
FIG. 12: shows a view along a vertical plane through the centreline of the stairlift rail, with the carriage mounted on the rail.

Given the number of components, and multiple axes of movement, within the roller assembly, it may be necessary to provide some means of removing free-play or slack between the assembly and the rail 13. To this end, as shown in FIG. 12, a small spring may be provided to bias the cross-member 54 away from the link 61. As illustrated, a small gas spring 70 is provided which biases the cross-member 54 downwardly. The gas spring 70 preferably includes a tensioning screw 71, the operation of which allows the spring tension to be reduced whilst the roller assembly is installed on to the rail 13.

Figure 5:
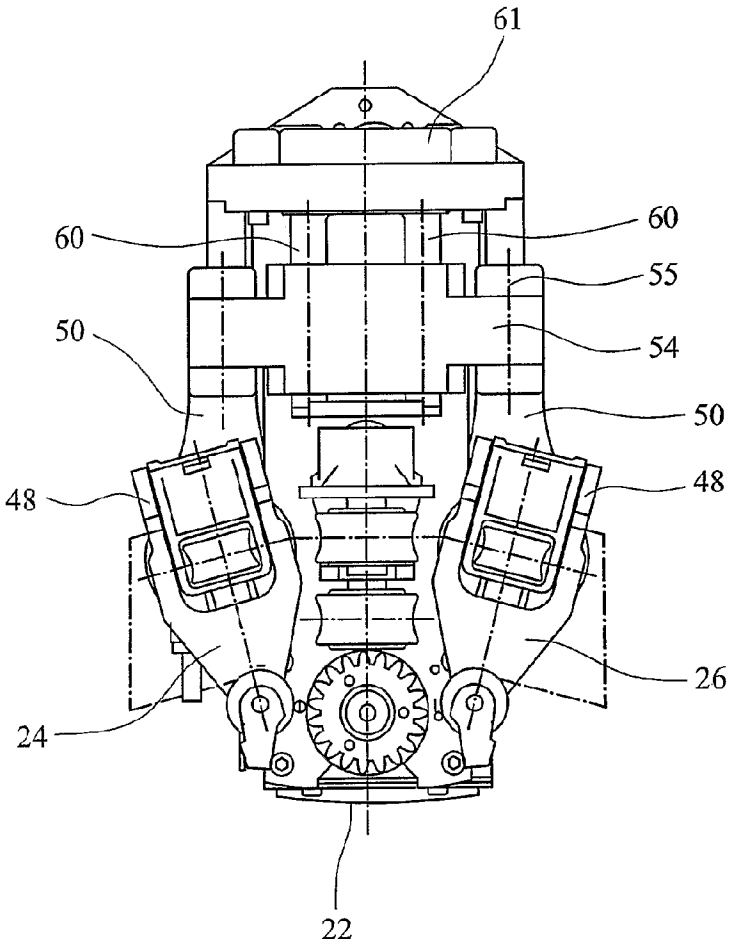
FIG. 5: shows a view similar to FIG. 2, but with the carriage traversing a negative transition bend.
Figure 4:
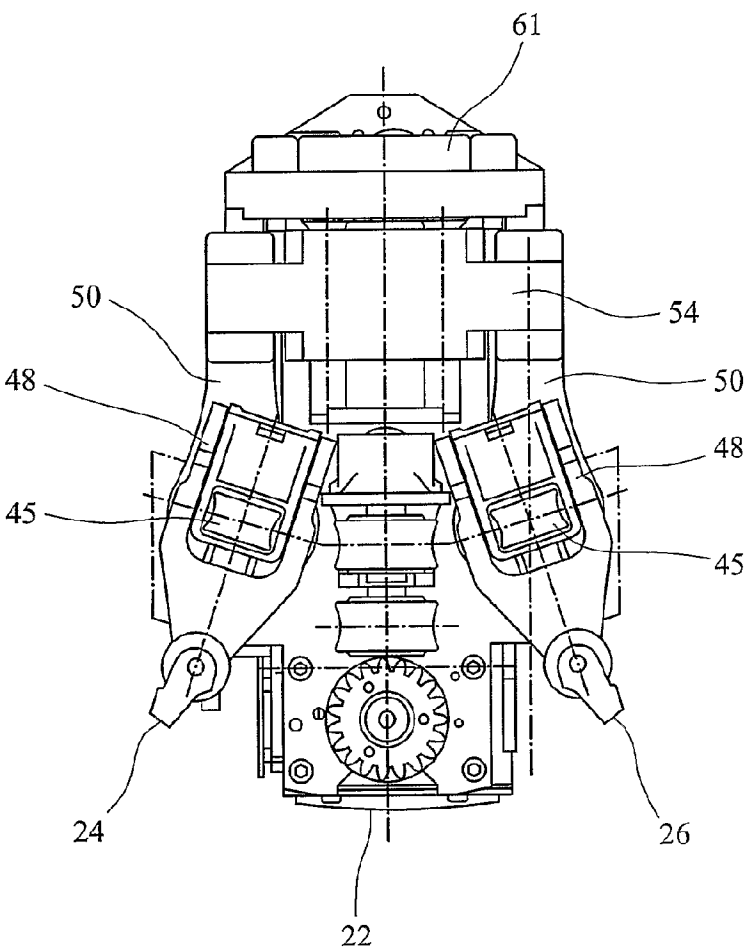
FIG. 4: shows a view similar to FIG. 2, but with the carriage traversing a positive transition bend in a stairlift rail.

The behaviour of the skate 20 in various bends can now be described. In pure transition bends, as shown in FIGS. 4 and 5, the yokes 48 with their attached rollers rotate about axes 53. In addition, the cross-member 54, together with all the components mounted thereon, moves up and down on pillars 60. In a positive transition bend, as shown in FIG. 4, the upper parts of the roller sets 24 and 26 move closer together whilst the lower parts move further apart. In addition the cross-member 54 slides up the pillars 60. In negative transition bends the situation is reversed with the upper parts of the roller sets 24 and 26 moving apart, the lower parts of the roller sets moving closer together, and the cross-member 54 sliding down the pillars 60.

It is important to note that there is no connection between the outer roller sets hindering the ability of each to pivot independently about its respective axis 53. This means that the leading roller set can pivot as it enters a bend, whilst the trailing set will remain at its present angular position with respect to the rail until it, too, enters the bend. In other words, each roller set is free to assume its own alignment with respect to the rail thus minimizing the possibility of crabbing.

The behaviour of the skate in inside/outside bends is illustrated in FIGS. 6 to 11 and it will be noted that the roller configuration adopted to accommodate these types of bend is distinctly different from the prior art referred to above.

In inside/outside bends, the outer roller sets 24 and 26 must not only have the ability to pivot around substantially vertical axes but further, and when viewed from above, the outer roller sets must be able to move, together, forward and rearward with respect to the central roller set. In prior art arrangements, such as shown in EP 9 853 591 and WO 2005/085116, a combination of sub-frames linked at their inner ends and pivoted at positions spaced from the link, ensures that the outer roller sets move forward and backward together, but allow less than ideal, or sufficient, rotation of the outer roller sets about vertical axes.

In accordance with the present invention, there is no geared or mirrored connection between outer roller sets 24 and 26. As in transition bends the rotation of roller sets 24 and 26 about their respective vertical pivots 55 results entirely from the inter-action between the carriage and the rail. As a consequence, the planes in which rollers 42 and 43 rotate, are always substantially parallel to the rail axis when viewed from above. This substantially eliminates the crabbing movement, and resulting wear, inherent in the prior art apparatus.

The vertical pivots 55 provide the required vertical rotation to accommodate inside/outside bends, and are located in the ideal positions—extending through the axes of rotation of the rollers 42 and 43. However the pivots 55, on their own, do not allow the required fore and aft movement of the outer rollers sets. It is in order to achieve the latter that the roller sets 24 and 26, and the cross-member 54, are mounted on pillars 60. Because the pillars 60 can rotate about the axis 62, this means that, at the level at which the roller sets engage the rail, the rollers sets 24 and 26 can move, simultaneously, forward and backward with respect to the central roller set 22.

Figure 7:
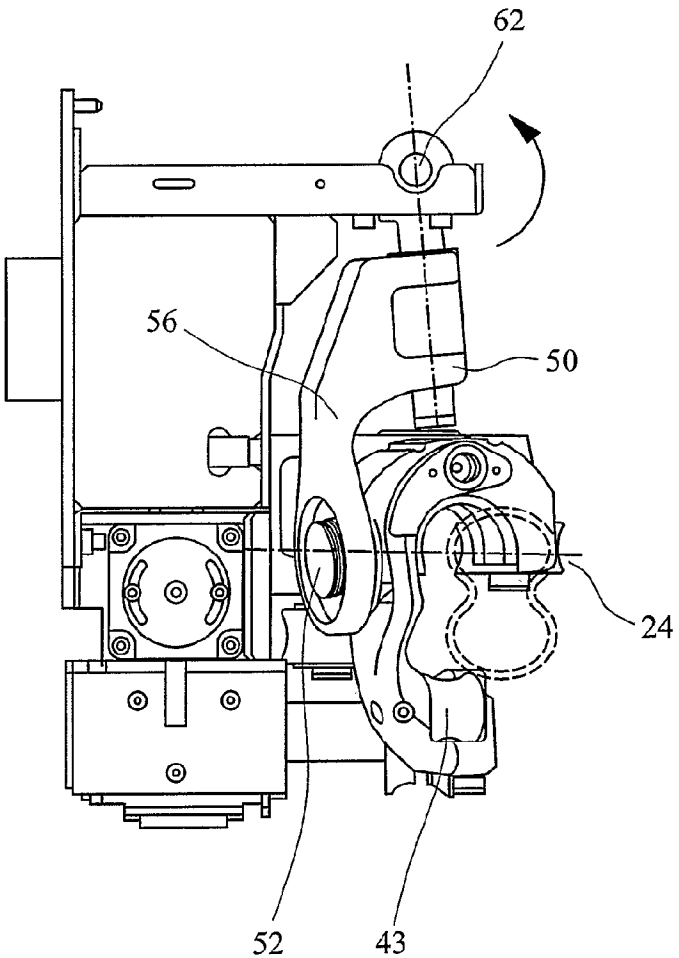
FIG. 7: shows a side view of that which is shown in FIG. 6.
Figure 6:
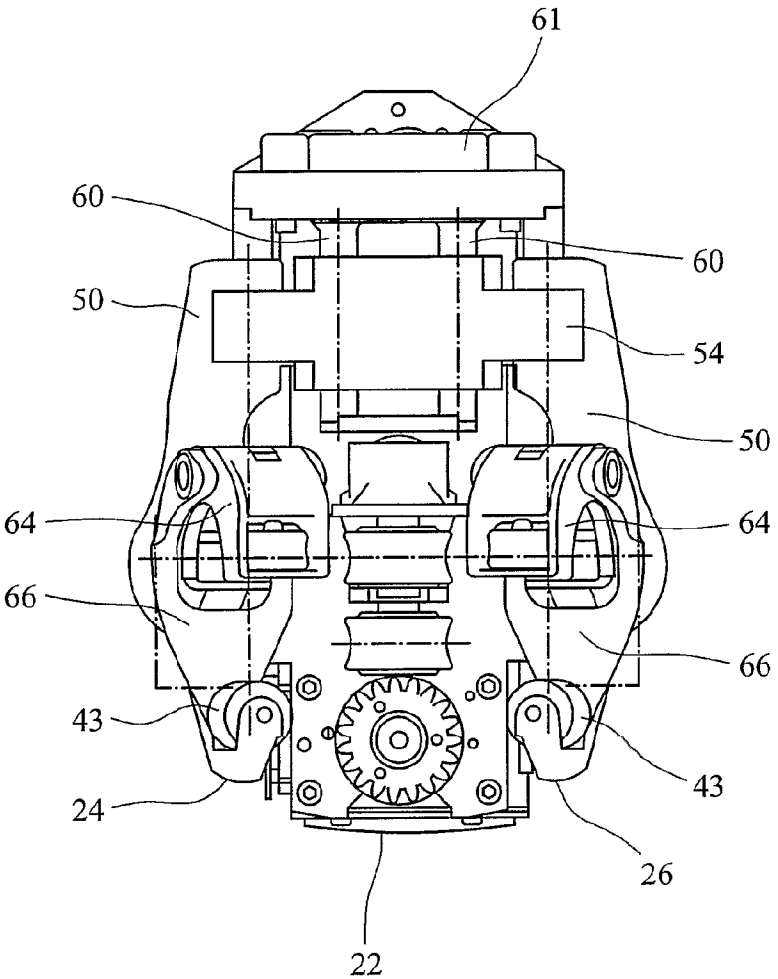
FIG. 6: shows a view similar to FIG. 2, but with the carriage traversing an inside bend in a stairlift rail.
Figure 8:
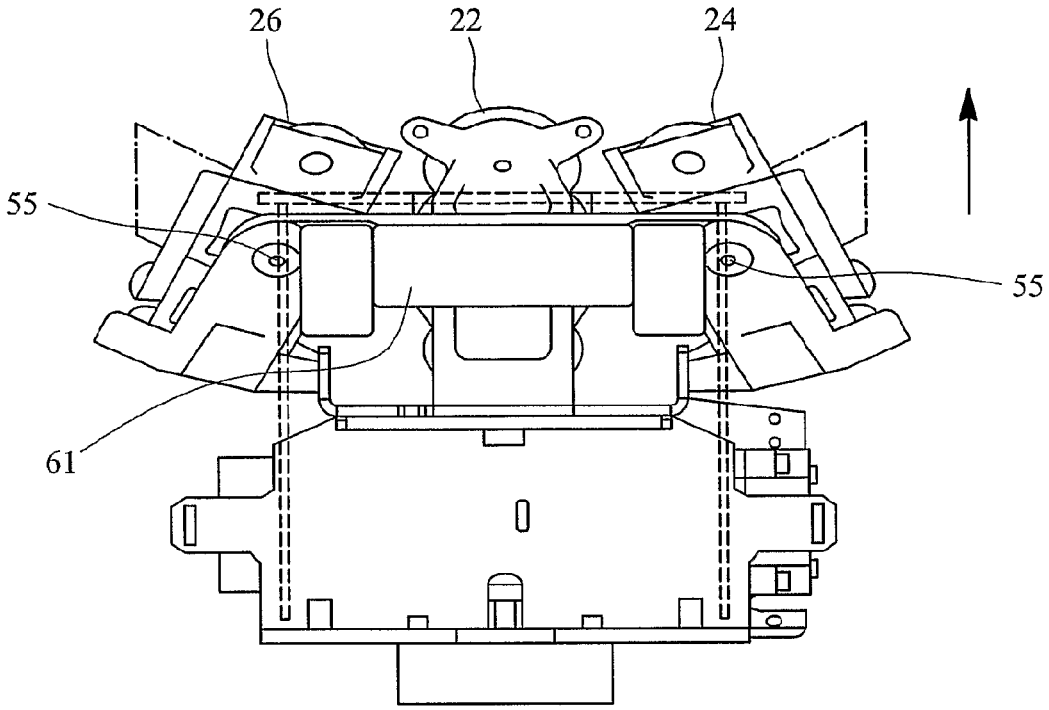
FIG. 8: shows a view from above of that which is shown in FIGS. 6 & 7.
Figure 11:
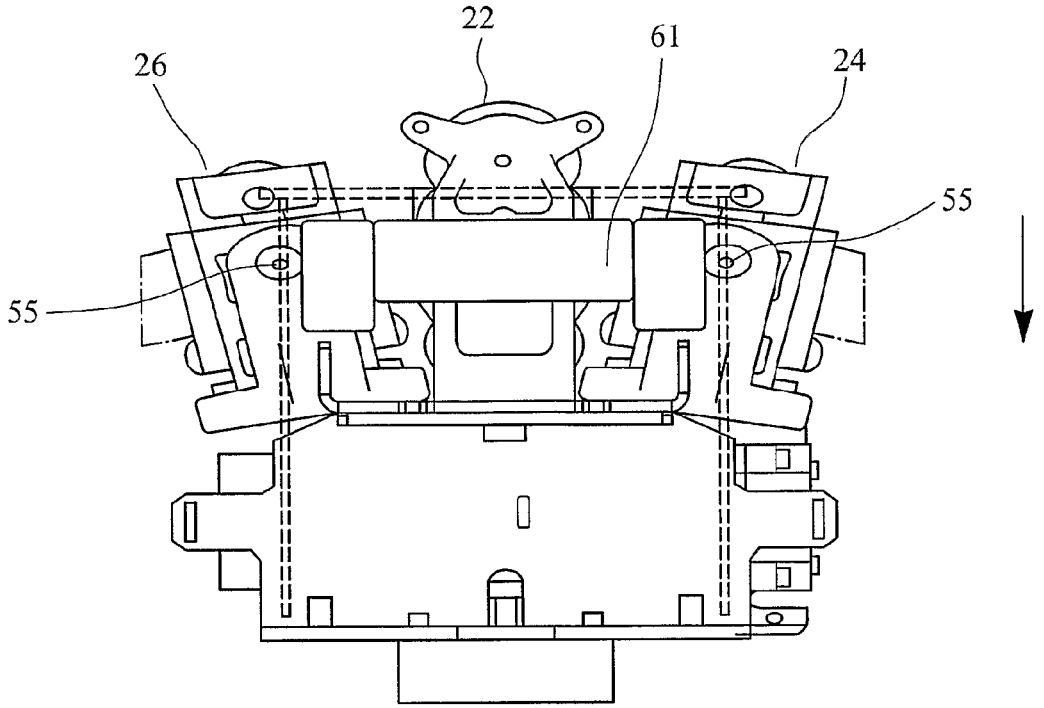
FIG. 11: shows a view from above of that which is shown in FIGS. 9 & 10.
Figure 10:
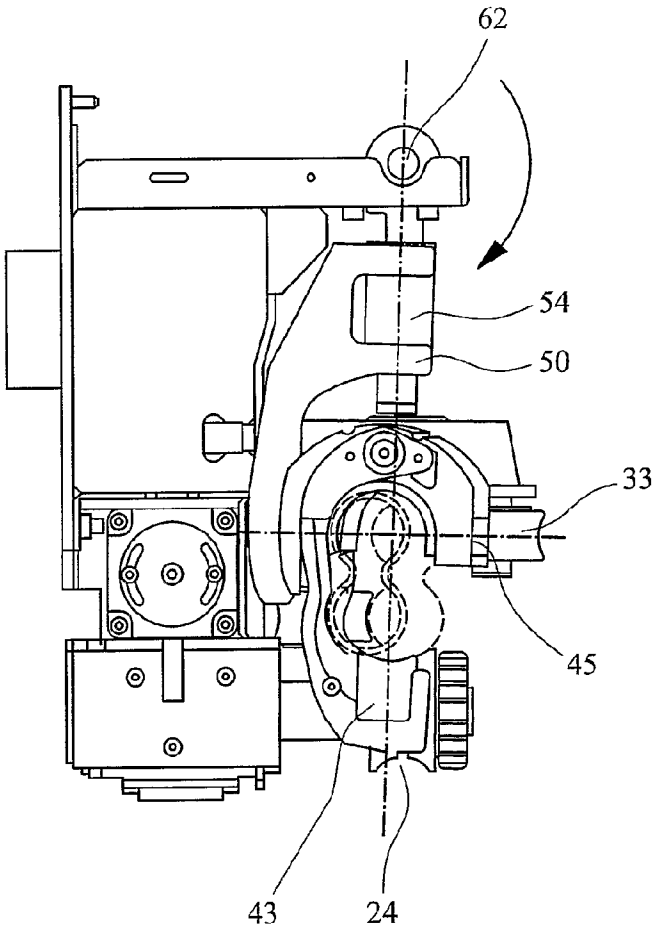
FIG. 10: shows a side view of that which is shown in FIG. 9.
Figure 9:
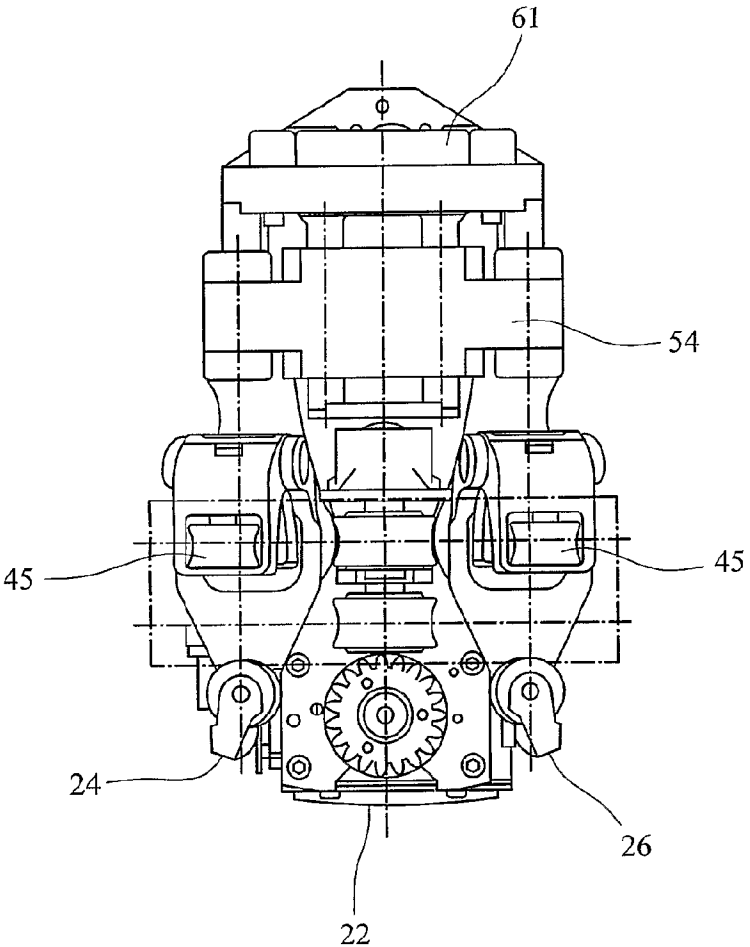
FIG. 9: shows a view similar to FIG. 2, but with the carriage traversing an outside bend in a stairlift rail.

The roller configuration in an inside bend is shown in FIGS. 6 to 8. As can be seen, the outer roller sets 24 and 26 pivot inwardly about vertical pivots 55, while the entire cross-member 54/roller sets 24, 26 moves forward by virtue of pillars 60 rotating in the direction of arrow in FIG. 7. Again the situation is reversed in an outside bend as shown in FIGS. 9 to 11. In such a bend the outer roller sets pivot outwardly as can be seen in FIG. 9, whilst the cross-member/roller sets 24, 26 are retracted in the direction of the arrow shown in FIG. 10.

It should be appreciated that whilst a pivoting arrangement is described above to achieve the necessary forward/backward movement in inside outside bends, the required movement could, instead, be achieved using a linear sliding arrangement. In this event, the cross-member and pillars could be mounted so as to slide forward and backwards on one or more linear sliding bearings.

The skate as described is equally capable of traversing helical bends although such a bend is not specifically illustrated.

Without detracting from the freedom of rotation available to the outer roller sets in the bends, described above, in order to assist entry into, and exit from, helical bends, each yoke 48 may be formed in two parts. The first part or central section 64 provides a mount for the top roller 42 and lateral steering rollers 44 and 45. The second part 66, in the form of a hanger which can move with respect to the central section 60, provides a mount for the bottom roller 43.

In the embodiment shown the hanger 66 is fixed to central yoke section 64 through a pivot point 68 positioned just above the top centre of the rail 13. Thus, the bottom roller 43 will move in an arc about the pivot 68. Whilst movement along this arc does not correspond exactly with the rail curvature, since the amount of arcuate movement required of roller 43 is relatively small when compared with the radius of the arc, the solution shown works quite satisfactorily. If necessary or desired the hanger may be spring biased to a central position.

A variation of the hanger arrangement described above can be found in our published International (PCT) Patent Application WO 2005/085116.

In the description above, reference has been made to the use of 'rollers'. However, it will be appreciate by those skilled in the art that one or more of the rollers described herein could be replaced by sliding bearings. Thus, the term 'roller' should be interpreted herein as including sliding bearing elements.

Figure 13:
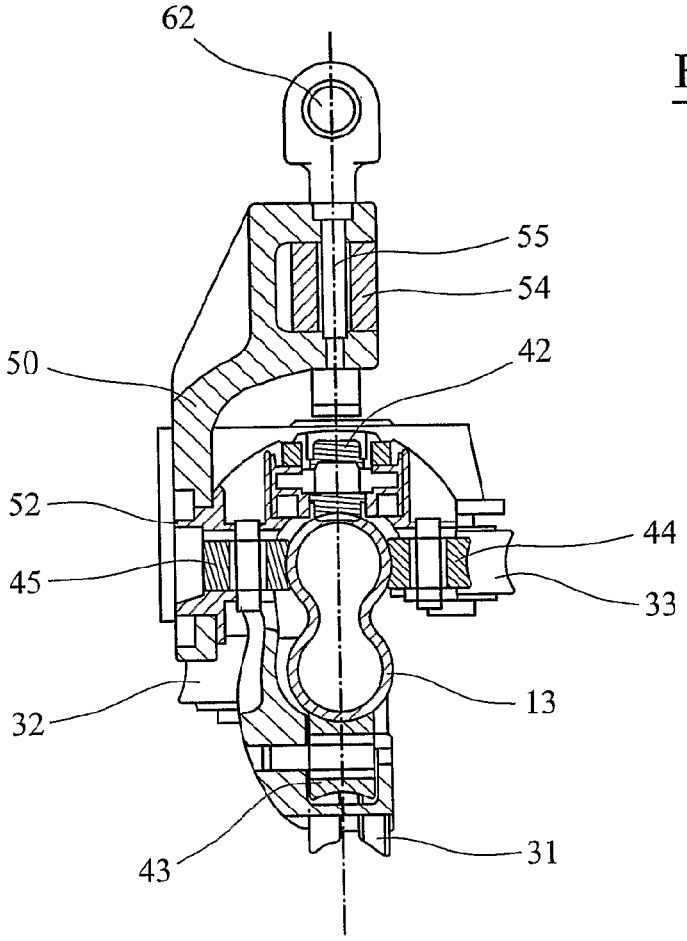
FIG. 13: shows a view along a vertical plane through the rail, perpendicular to the axis of the rail, and through the connection between a sub-frame and the carriage chassis.
Figure 14:
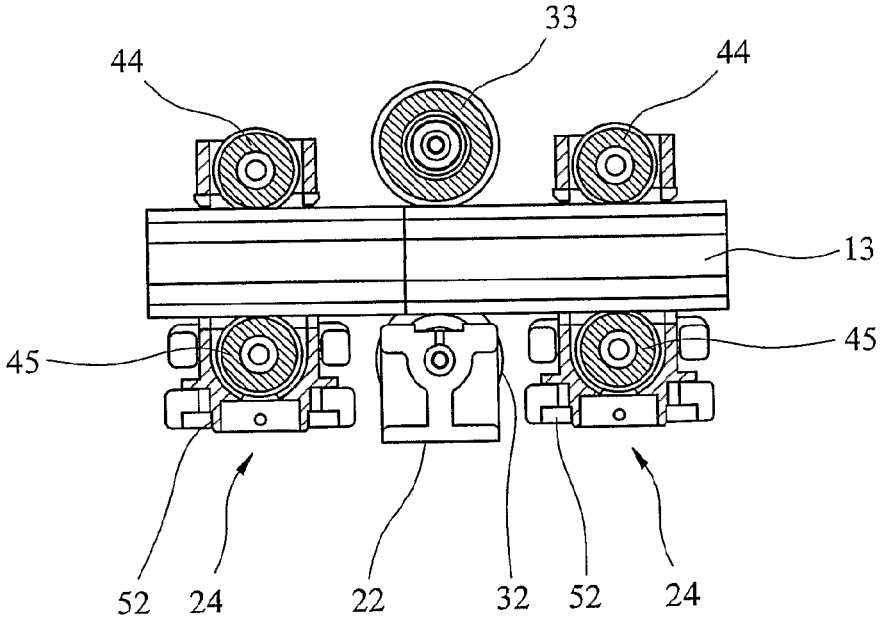
FIG. 14: shows a view along a horizontal plane through the stairlift rail, with a carriage mounted on the rail.

It will thus be appreciated that the present invention provides a novel and inventive roller configuration which, at least in the preferred embodiment described herein, and in combination with the rail configuration shown in FIG. 13, has the following advantages:

1. Because each outer roller set is free to independently rotate about orthogonal axes, the individual rollers can assume ideal tracking positions. As a consequence crabbing is minimised, as is roller and roller bearing wear.
2. The absence of long pivoting linkages governing the rotation of the outer roller sets, especially in inside/outside bends, together with the fact that the orthogonal axes of rotation of the respective sets lie in common planes, means that twisting moments are eliminated and carriage stability is markedly increased.
3. The elimination of separate pivoting linkages between the outer roller sets reduces costs and reduces the overall bulk of the skate.

The invention claimed is:

1. A stairlift carriage for mounting on a stairlift rail having a rail axis, said carriage including:

a central roller set to locate and retain said carriage on said rail; and outer roller sets on either side of said central roller set, said outer roller sets being operable to guide said carriage through transition and/or inside/outside bends in said rail, said carriage being characterised in that a connection is provided linking said outer roller sets and operable to ensure simultaneous displacement of said outer roller sets with respect to said central roller set, and each outer roller set is mounted to said connection for pivotal movement about two substantially orthogonal axes, the pivotal movement of one outer roller set about each of said orthogonal axes being independent of the pivotal movement of the other outer roller set about each of said orthogonal axes.

2. A stairlift carriage as claimed in claim 1 wherein said two orthogonal axes lie on a common plane.

3. A stairlift carriage as claimed in claim 2 wherein said common plane is substantially perpendicular to said rail axis.

4. A stairlift carriage as claimed in claim 2 wherein said connection is displaceable about an axis spaced from, but substantially parallel to, a line extending between said outer roller sets.

5. A stairlift carriage as claimed in claim 2 wherein each outer roller set includes a top and bottom roller, positioned to engage, respective surfaces of said rail at or adjacent the upper and lower edges thereof; and a plurality of steering rollers positioned to engage opposed side surfaces of said rail.

6. A stairlift carriage as claimed in claim 2 wherein said connection includes a rigid cross-member operable to cause simultaneous displacement of said outer roller sets with respect to said central roller set in both transition bends and inside/outside bends.

7. A stairlift carriage as claimed in claim 3 wherein said connection includes a rigid cross-member operable to cause simultaneous displacement of said outer roller sets with respect to said central roller set in both transition bends and inside/outside bends.

8. A stairlift carriage as claimed in claim 3 wherein said connection is displaceable about an axis spaced from, but substantially parallel to, a line extending between said outer roller sets.

9. A stairlift carriage as claimed in claim 3 wherein each outer roller set includes a top and bottom roller, positioned to engage, respective surfaces of said rail at or adjacent the upper and lower edges thereof; and a plurality of steering rollers positioned to engage opposed side surfaces of said rail.

10. A stairlift carriage as claimed in claim 1 wherein said connection includes a rigid cross-member operable to cause simultaneous displacement of said outer roller sets with respect to said central roller set in both transition bends and inside/outside bends.

11. A stairlift carriage as claimed in claim 10 wherein said cross-member is slidable in a substantially vertical direction.

12. A stairlift carriage as claimed in claim 10 wherein said connection is displaceable about an axis spaced from, but substantially parallel to, a line extending between said outer roller sets.

13. A stairlift carriage as claimed in claim 10 wherein each outer roller set includes a top and bottom roller, positioned to engage, respective surfaces of said rail at or adjacent the upper and lower edges thereof; and a plurality of steering rollers positioned to engage opposed side surfaces of said rail.

14. A stairlift carriage as claimed in claim 11 wherein each outer roller set includes a top and bottom roller, positioned to engage, respective surfaces of said rail at or adjacent the upper and lower edges thereof; and a plurality of steering rollers positioned to engage opposed side surfaces of said rail.

15. A stairlift carriage as claimed in claim 11 wherein said connection is displaceable about an axis spaced from, but substantially parallel to, a line extending between said outer roller sets.

16. A stairlift carriage as claimed in claim 15 wherein each outer roller set includes a top and bottom roller, positioned to engage, respective surfaces of said rail at or adjacent the upper and lower edges thereof; and a plurality of steering rollers positioned to engage opposed side surfaces of said rail.

17. A stairlift carriage as claimed in claim 1 wherein each outer roller set includes a top and bottom roller, positioned to engage, respective surfaces of said rail at or adjacent upper and lower edges thereof; and a plurality of steering rollers positioned to engage opposed side surfaces of said rail.

18. A stairlift including a carriage as claimed in claim 17.

19. A stairlift carriage as claimed in claim 1 wherein said connection is displaceable about an axis spaced from, but substantially parallel to, a line extending between said outer roller sets.

* * * * *